US005888689A

United States Patent [19]

De Meutter et al.

[11] Patent Number: 5,888,689

[45] Date of Patent: Mar. 30, 1999

[54] METHOD FOR PRODUCING CROSS-LINKED FIXED TONER IMAGES

[75] Inventors: Stefaan De Meutter, Antwerp; Serge Tavernier, Lint; Danny Van Wunsel, Westerlo, all of Belgium

[73] Assignee: Agfa-Gevaert, N.V., Mortsel, Belgium

[21] Appl. No.: 885,723

[22] Filed: Jun. 30, 1997

Related U.S. Application Data

[60] Provisional application No. 60/026,551, Sep. 23, 1996.

[30] Foreign Application Priority Data

Jul. 26, 1996 [EP] European Pat. Off. ..... 96202127

[51] Int. Cl.[6] ..... G03G 13/20; G03G 15/20

[52] U.S. Cl. ..... 430/124; 430/97; 399/320

[58] Field of Search ..... 430/97, 124

[56] References Cited

U.S. PATENT DOCUMENTS

| | | | |
|---|---|---|---|
| 3,207,601 | 9/1965 | Giaimo | 430/124 |
| 3,215,527 | 11/1965 | Johnson | 430/124 |
| 3,231,374 | 1/1966 | Sciambi | 430/124 |
| 3,385,699 | 5/1968 | Honjio | 430/124 |
| 3,723,114 | 3/1973 | Hagenbach et al. . | |
| 3,745,002 | 7/1973 | Honjo et al. . | |
| 5,212,526 | 5/1993 | Domoto et al. | 430/124 |
| 5,470,683 | 11/1995 | Inaishi | 430/106 |

FOREIGN PATENT DOCUMENTS

| | | | |
|---|---|---|---|
| 0 104 626 A1 | 4/1984 | European Pat. Off. . | |
| 0 601 235 A1 | 6/1994 | European Pat. Off. . | |
| 0 667 381 A1 | 8/1995 | European Pat. Off. . | |
| 43-21786 | 9/1968 | Japan | 430/124 |

*Primary Examiner*—Roland Martin
*Attorney, Agent, or Firm*—Breiner & Breiner

[57] ABSTRACT

A method for forming images is provided, comprising the steps of:

i) providing a substrate comprising reactive group RGB, ii) providing toner particles comprising reactive group RGA, iii) image-wise depositing the toner particles on the substrate and iv) reacting the reactive group RGA with the reactive group RGB so as to harden the toner particles.

The reactive group RGA and the reactive group RGB are a member selected from the group consisting of epoxy groups, aldehyde groups, hydroxyl groups, carboxyl groups, mercapto groups, amino groups and amide groups and are chosen such as to form a reaction pair.

16 Claims, No Drawings

METHOD FOR PRODUCING CROSS-LINKED FIXED TONER IMAGES

The application claims the benefit of US Provisional application Ser. No. 60/026,551, filed Sept. 23, 1996.

1. FIELD OF THE INVENTION

The present invention relates to a method for producing toner images, wherein the toner images are strongly attached to the substrate and are highly resistant to wear.

2. BACKGROUND OF THE INVENTION

In imaging methods as e.g. electro(photo)graphy, magnetography, ionography, etc. a latent image is formed that is developed by attraction of so called toner particles. Afterwards the developed latent image (toner image) is transferred to a final substrate and fused to this substrate. In DEP the so called toner particles are imagewise deposited directly on a final substrate and fused to this substrate.

Toner particles are basically polymeric particles comprising a polymeric resin as main component and various ingredients mixed with said toner resin. Apart from colourless toners, which are used e.g. for finishing function, the toner particles comprise at least one black and/or colouring substances, e.g., coloured pigment.

In the different imaging methods, described above, the toner particles can be present in a liquid or in a dry developer composition.

In most cases the use of dry developer compositions is preferred. The main advantage of using a dry developer composition resides in the absence of the need to eliminate the liquid phase after development. The avoidance of the need to evacuate (mainly organic) liquids is desirable both from an economical standpoint and from an ecological standpoint.

However, in all techniques using dry particulate material to form an image, the images are very frequently built up by application of particulate marking elements in multiple, superimposed layers onto the substrate. The problems associated with multiple, superimposed layers of particulate marking particles that are in one way or another fixed on a substrate are manifold, not only with respect to image quality but also with respect to image stability and with respect to mechanical issues.

In, e.g. EP-A 471 894, EP-A 554 981, U.S. Pat. No. 4,828,950 and U.S. Pat. No. 4,885,603, it has been disclosed to apply a layer of transparent toner particles on top of the toner image to provide better resistance to physical damage. Also other means and ways to produce toner images that are very resistant to external influences, (e.g. mechanical influence, heat, contact with solvents, etc) have been proposed.

In, e.g., U.S. Pat. No. 3,723,114 the problem of storage properties of fused toner images is addressed, the main problem being the fact that the toner images can, depending on the storage conditions, become tacky after storage. The problem is solved by using in the toner resin a substantial portion of thermosetting polymers.

The use of photo-curable toners has been suggested in, e.g., U.S. Pat. No. 5,470,683 to produce toner images having better weather resistance. In that application, a capsule toner is provided having a core comprising a polymerisable compound, a polymerization initiator and other normal toner ingredients. The core is surrounded by a hard shell that breaks during the fixing step. After the fixing step the polymerisable compound is polymerized, in this particular disclosure, by low energy visible light. Although following the teachings of these disclosures leads to the production of toner layers that are not easily damaged, the nature of the solutions itself limits the variety of resins that can be used in the manufacturing of the toner. Therefore further improvements along the lines of the disclosures referred to above are desirable.

3. OBJECTS AND SUMMARY OF THE INVENTION

It is an object of the invention to provide a method for producing toner images that are very resistant to external physical influences wherein the toner particles used do not have to incorporate a restricted number of specific toner resins.

It is a further object of the invention to provide a method for forming toner images wherein said toner image is very resistant to the influence of common organic solvents.

It is an other object of the invention to provide a method for producing toner images wherein the toner image is strongly bound to the toner receiving substrate.

It is a further object of the invention to provide a method for producing toner images that are very weather resistant.

Further objects and advantages of the present invention will become evident from the detailed description hereinafter.

The objects of this invention are realized in a first embodiment of this invention by providing a method for forming a toner image on a substrate comprising the steps of:

i) providing a substrate comprising reactive groups RGB, ii) providing toner particles comprising reactive groups RGA, iii) image-wise depositing said toner particles on said substrate, forming an image and iv) reacting said reactive groups RGA with reactive groups RGB so as to harden said toner particles.

The objects of this invention are realized in a second embodiment of this invention by providing a method for forming a toner image on a substrate comprising the steps of:

i) providing toner particles comprising reactive groups RGA, ii) image-wise depositing said toner particles on said substrate, forming an image, iii) applying a compound comprising reactive groups RGB on said image and iv) reacting said reactive groups RGA with said reactive groups RGB so as to harden said toner particles.

4. DETAILED DESCRIPTION OF THE INVENTION

It was found that it was possible to produce on a substrate toner images with high resistance to external influences (i.e. mechanical wear, degradation by heat, attack by organic solvents, weather, etc) by hardening the (fused) toner particles comprised in said image. This hardening proceeds by reacting reactive groups RGA present in the toner particles with reactive groups RGB in order to harden the toner particles. This hardening can proceed via two methods: in a first method, the toner particles comprise reactive groups RGA and the substrate comprises reactive groups RGB and both reactive groups are chosen such that they interact with each other. In a second method a so called "cross-linker" or "hardening" agent, comprising reactive groups RGB, is applied on top of the toner image and made to react with reactive groups RGA contained in the toner particles. Although both methods as such did produce toner images that were very resistant to mechanical influences, it is possible, within the scope of the present invention, to combine both methods to further increase the hardness and mechanical resistance of the toner images. An "image on a substrate" is, in the context of this invention, meant to include a substrate carrying human readable or/and machine readable text, a substrate carrying figures, a substrate carrying pictures (both coloured and monochromatic) as well as a substrate carrying a combination of at least two of the above.

THE FIRST EMBODIMENT OF THE INVENTION

In the first embodiment of this invention a specific chemical interaction between the toner particles and a substrate is used to enhance the mechanical strength of a toner image and/or of the binding between toner image and substrate.

We have found that the drawbacks of earlier methods to provide mechanically strong toner images could be solved by providing toner particles comprising reactive groups (RGA) and have these reactive groups (RGA) react with reactive groups (RGB) present in the substrate. After said reaction said toner particles were cross-linked and/or chemically bound to said substrate. Herein after, the word "harden" and words derived from it will be used to mean cross-link and/or chemically fix said toner particles to said substrate.

Both said reactive groups RGA and said reactive groups RGB are preferably members selected from the group consisting of epoxy groups, aldehyde groups, hydroxyl groups, carboxyl groups, mercapto groups, amino groups and amide groups. The reactive groups RGA and RGB are preferably chosen such as to form a reaction pair that reacts easily (i.e. fast, at relatively low temperature) together. Both reactive groups (RGA and RGB) can be part of a polymeric, oligomeric or low molecular weight (molecular weight lower than 2000) molecule. The molecule carrying reactive groups RGA and reactive groups RGB can carry one or more of these reactive groups. The toner particles and/or the substrate can comprise, if so desired, a mixture of compounds carrying reactive groups. E.g. the toner particles can comprise a compound comprising hydroxyl groups together with a compound comprising epoxy groups. Also in the substrate different compounds carrying reactive groups can be present, it can e.g. be useful to mix in the substrate a polymeric compound comprising reactive groups with a low molecular weight molecule comprising reactive groups. The reaction between the reactive groups (RGA and RGB) results in cross-linking of the toner particles, in chemically fixing the toner particles to the substrate or in both cross-linking the toner particles and chemically fixing them to the substrate. The type of reaction that occurs, (cross-linking or chemical fixing), depends on the nature of the compound carrying the reactive groups. When e.g. the reactive groups RGA in the toner particles are comprised in a polymeric compound and the reactive groups RGB in the substrate in a low molecular weight molecule carrying e.g. two reactive groups RGB, then, during fusing of the toner particles to the substrate, the low molecular weight molecule can migrate from the substrate and cross-link two polymeric compounds, carrying reactive groups RGA, present in the toner particles. When e.g. both the reactive groups RGA and RGB are contained in polymeric compounds, then during fusing the reaction between RGA and RGB will rather result in a chemical fixing of the (fused) toner particles to the substrate. Thus by carefully choosing compounds of different nature (polymeric, oligomeric or low molecular weight molecule), carrying reactive groups RGA and also carefully choosing compounds of different nature (polymeric, oligomeric or low molecular weight molecule), carrying reactive groups RGB, the ratio between the cross-linking and chemical fixing reaction can be adapted to the needed hardness of the toner layer and to the needed strength of fixing of the fused toner particles to the substrate. Typical reaction pairs, comprising reactive groups RGA or RGB, and very useful in the present invention are e.g.:

i) polyaminoamide resins having an amine value (expressed in KOH equivalents) between 140 and 430 mg KOH/g and compounds comprising epoxy groups. Polyaminoamide resins useful for this invention are available under trade name UNIREZ from Union Camp Chemicals Ltd, Bedlington, Northumberland NE22 7DH, UK a subsidiary of Union Camp Corp. USA. The epoxy group can beneficially be part of an epoxy resin as e.g. ARALDITE GT 7203 (trade name for an epoxy resin of Ciba-Geigy of Switserland) and EPIKOTE 1004 (trade name of Shell Company, UK).

ii) polymers having an acid value larger than 2.5 mg KOH/g or a hydroxyl value larger than 2.5 mg KOH/g and compounds carrying epoxy groups, as described immediately above.

iii) polymers comprising epoxy groups, as described above, and polyaziridines, iv) polymers having an acid value larger than 2.5 mg KOH/g or a hydroxyl value larger than 2.5 mg KOH/g and polyaziridines.

v) polymers having an acid value larger than 2.5 mg KOH/g or a hydroxyl value larger than 2.5 mg KOH/g and polyabietic acid.

vi) polymers having an acid value larger than 2.5 mg KOH/g or a hydroxyl value larger than 2.5 mg KOH/g and highly methylated melamine resins. The latter are available under trade names CYMEL 300, CYMEL 301, CYMEL 303 and CYMEL 350 through American Cyanamid Company USA. Examples of polymers having an acid value larger than 2.5 mg KOH/g or a hydroxyl value larger than 2.5 mg KOH/g and very useful in this invention are tabulated in table 1.

vii) polyamide resins and hardening agents comprising epoxy groups.

viii) polyester/polyamide copolymers and hardening agents comprising epoxy groups.

Since toner particles to be used in electrostatographic printing apparatus have preferably quite a high mechanical strength in order to be able to withstand the mechanical influences (pressure, friction, etc) in the printing apparatus before and during development, it is important to preserve the mechanical strength of the toner particles. Therefore the compounds comprising reactive groups RGA are preferably solids that do not deteriorate the mechanical strength of the toner particles in which they are incorporated. Thus, in a preferred embodiment said reactive groups RGA are part of a polymer used as toner resin (either alone or in mixture with other known toner resins) and said resin carrying reactive groups RGA has preferably a $Tg \geqq 35°$ C., preferably larger than 40° C.

Thus when using reaction pairs as described above in the first embodiment of this invention, the polymeric compounds carrying reactive groups are preferably incorporated in the toner particles.

Very suitable polymers having an acid value>2.5 mg KOH/g and/or a hydroxyl value>2.5 mg KOH/g, for use in toner particles used in the method of this invention, can be polycondensation polymers as well as addition polymers, typical examples are tabulated in table 1.

The reactive groups RGA can also be part of an epoxy-resin that is incorporated in or is the toner resin of the toner particles. Typical examples of useful epoxy resins (polymers) are e.g. ARALDITE GT 7203 (trade name for an epoxy resin of Ciba-Geigy of Switserland) and EPIKOTE 1004 (trade name of Shell Company, UK). The compound carrying reactive groups RGA and incorporated in the toner particles, can also be a polyamide resin or a polyester/polyamide copolymer.

TABLE 1

| Chemical structure | AV* | HV** | Tg °C. | Mn+ | Mw† |
|---|---|---|---|---|---|
| 1. Polyester resin of terephthalic acid, ethyleneglycol and DIANOL 22 | 3 | 31.1 | 62 | 3.6 | 10 |
| 2. Polyester resin of fumaric acid and DIANOL 33 | 17 | 5.2 | 55 | 4.4 | 12 |
| 3. Polyester resin of terephthalic acid, isophthalic acid and DIANOL 22 and ethyleneglycol | 18 | 20.9 | 60 | 4 | 18 |
| 4. Copoly(styrene-butylacrylate-butylmethacrylate-stearyl-methacrylate-methacrylic acid) (65/5/21/5/4) | 12 | 0 | 58 | 6 | 108 |
| 5. Copoly(styrene-butyl-methacrylate-acrylic acid) (80/15/5) | 5 | 0 | 63 | 5.5 | 180 |
| 6. Polyester resin of DIANOL 33/DIANOL 22, terephthalic acid and trimellitic acid | 30 | 50 | 65 | 2.0 | 14 |
| 7. Co(Styrene/n-butyl-methacrylate), diCOOH terminated (65/35) | 15 | 0 | 48 | 2.1 | 10 |

*AV: acid value in mg KOH/g resin
**HV: hydroxyl value in mg KOH/g resin
+Mn: numerical average molecular weight (×1000)
†Mw: weight average molecular weigh (×1000)
DIANOL 22 is a trade name of AKZO CHEMIE of the Netherlands for bis-ethoxylated 2,2-bis(4-hydroxyphenyl)propane.
DIANOL 33 is a trade name of AKZO CHEMIE of the Netherlands for bis-propoxylated 2,2-bis(4-hydroxyphenyl)propane.

The chemical compound (polymeric, oligomeric or single molecule) carrying reactive groups RGA, can be present in the bulk of the toner particles, on the surface of the toner particles or both in the bulk and on the surface of the toner particles.

Toner particles comprising compounds with reactive groups RGA in the bulk of the particle can be prepared by melt kneading the toner ingredients (e.g. toner resin, charge control agent, pigment, etc) and said compounds with reactive groups RGA. After the melt kneading the mixture is cooled and the solidified mass is pulverized and milled and the resulting particles classified. Also the "emulsion polymerisation" and "polymer emulsion" techniques for toner preparation can be used to prepare toner particles wherein compounds with reactive groups RGA are incorporated in the bulk of the toner particles. In the "emulsion polymerization" technique a water-immiscible polymerizable liquid is sheared to form small droplets emulsified in an aqueous solution, and the polymerization of the monomer droplets takes place in the presence of an emulsifying agent; such a technique is described e.g. in U.S. Pat. No. 2,932,629, U.S. Pat. No. 4,148,741, U.S. Pat. No. 4,314,932 and EP-A 255 716. In the "polymer emulsion" technique, a pre-formed polymer is dissolved in an appropriate organic solvent that is immiscible with water, the resulting solution is dispersed in an aqueous medium that contains a stabilizer, the organic solvent is evaporated and the resulting particles are dried; such a technique is described in, e.g., U.S. Pat. No. 4,833,060.

Toner particles having compounds carrying reactive groups at the surface can be prepared as described in EP-A 725 317. In this European Application a method for producing toner particles is disclosed, comprising the steps of:

(i) dissolving at least one organic polymer (toner resin) in a solvent therefor to form a solution, said solvent being immiscible with water, (ii) dispersing said solution in an aqueous phase to form a dispersion of small droplets, (iii) removing the solvent by evaporation from the dispersed droplets and (iv) separating solid polymeric particles from the water of the aqueous phase, characterized in that:

I. the dispersion of said small droplets is stabilized by the presence in the said aqueous phase of a dissolved water-soluble (co)polymer, comprising hydrophobic and hydrophilic moieties and that II. after evaporation of said solvent said water-soluble (co)polymer is at least partially transformed to a water-insoluble compound and is precipitated onto said solid polymeric particles.

It is taught that preferred stabilizer (co)polymers are being copolymers of vinyl acetate and crotonic acid (90/10 by weight) having a total acid number of 50 to 300, and copolymers of styrene and maleic acid anhydride having a total acid number of 250 to 500, both said copolymers being used, at least partially, transformed into their ammonium salt form. The water-soluble stabilizing (co)polymer is precipitated on to the particles, produced by the method according to this invention, by chemical reaction, e.g. acidification of the aqueous medium, the water-soluble (co)polymer adhering to the dispersed polymer particles can be transformed into a water-insoluble species that precipitates on the particles. By doing so carboxylic acid groups are present at the surface of the toner particles.

The hardening reaction (the reaction between reactive groups RGA and RGB), according to this invention, proceeds easily when the interpenetration between toner particles and substrate is quite high. This interpenetration is reached by heating the toner particles on the substrate (during fixing or after fixing in an additional heating step) to a temperature that preferably is at most 150°, most preferably at most 120° C. Therefore it is preferred to use toner particles, comprising compounds carrying reactive groups RGA, that have a meltviscosity at 120° C. between 50 and 2000 Pas, preferably between 100 and 1000 Pas. All melt viscosities mentioned herein are measured in a RHEOMETRICS dynamic rheometer, RVEM-200 (One Possumtown Road, Piscataway, N.J. 08854 USA). The viscosity measurement is carried out at a sample temperature of 120° C. The sample having a weight of 0.75 g is applied in the measuring gap (about 1.5 mm) between two parallel plates of 20 mm diameter one of which is oscillating about its vertical axis at 100 rad/sec and amplitude of $10^{-3}$ radians.

The reaction between reactive groups RGA and RGB can beneficially be speeded up by providing catalysers for this reaction. Said catalysers are preferably acids (organic or anorganic) or tertiary amines. Typical examples of suitable catalysers are p-toluenesulfonic acid, trimethylamine and triethylamine. The catalyser or catalysers can, within the scope of the present invention, be incorporated in the toner particles, the substrate or both in the toner particles and the substrate. The catalyser or catalysers can be incorporated in the toner particles, as long as the incorporation of it does not result in a weakening of the mechanical resistance of the toner particles, i.e. when the Tg stays equal to or higher than 35° C.

It may be beneficial that the toner particles not only comprise reactive groups RGA, e.g., a member selected from the group consisting of epoxy groups, aldehyde groups, hydroxyl groups, carboxyl groups, mercapto groups, amino groups and amide groups, but comprise further a compound or mixture of compounds carrying radiation curable groups.

Thus, the present invention includes also a method for forming toner images on a substrate comprising the steps of:

i) providing a substrate comprising reactive groups RGB, i)image-wise applying toner particles comprising reactive groups RGA, a UV curable compound and a photoinitiator on said substrate, ii) fusing said toner particles to said substrate, forming a fused and hardened toner image, and iii) UV curing said UV curable compound.

The UV-curing can proceed on line, e.g, in the fusing station itself of an electrostatographic apparatus or in a station immediately adjacent to said fusing station.

The radiation curing can proceed off-line in a separate apparatus wherein the fused layer of toner particles is heated again and irradiated with curing rays.

To preserve the mechanical strength of the toner particles, it is preferred that the compounds, carrying a radiation curable group, to be incorporated in toner particles for use according to this invention, is already an oligomeric or polymeric compound instead of a monomer. A monomeric compound may be present in the mixture of radiation curable compounds, as long as the mixture of radiation curable compounds itself has a Tg≧35° C. Although electron beam curable groups can be used in the present invention, the radiation curable groups are preferably curable by UV-light. Very useful radiation curable polymeric compounds, in toner particles for use in the present invention are UV curable solid epoxy resins with Tg≧35° C. as disclosed in EP-A 667 381. In this application solid compositions (I) are described containing (a) a solid, oligomeric, cationically polymerisable polyglycidyl ether or ester (II), or a mixture of (II) with a liquid or crystalline monomeric mono-, di- or poly-epoxy resin, or a mixture of (II) with a cyclic acetal, where (II) have a Tg of above 35 deg. C., (b) a multifunctional nucleophilic chain transfer agent, (c) 0.05–3 wt. % photoinitiator for cationic polymerisation (with respect to the amount of a), and (d) optionally normal additives for coating powders.

These compositions (I) are melted together and the cooled mixture is milled. The exemplified compositions have a Tg between 65 and more than 115° C.

Other useful UV curable resins for incorporation in toner particles are powders based on unsaturated polyesters and polyurethaneacrylates, a typical example of such a polymeric UV curable system is available through Hoechts High Chem, Hoechts-Sara Pero (Mi) Italy. Such a system comprises a solid unsaturated polyester resin available under trade name AFTALAT VAN 1743, having a Tg≧52° C. and an urethane adduct with acrylic functional groups available under trade name ADDITOL 03546, having a Tg≧47° C. The properties of this system have be described in European Coating Journal n° 9/95 606–608 (1995). Also non-acrylate binder systems are useful in the present invention, e.g. a powder composed of a mixture of an unsaturated polyester resin in which maleic acid or fumaric acid is incorporated and a polyurethane containing a vinylether. Such a binder system has been developed by DSM resins of the Netherlands and the properties thereof have been described in European Coating Journal n° 3/96 115–117 (1996).

For the UV curing to proceed it is necessary that a photoinitiator is present. Very useful initiators are sulphonium salts as e.g. triarylsulphonium salts, triarylsulphoniumhexafluorophosphate, benzophenones, etc. Typical very useful photoinitiators in the context of this invention, are, e.g.,.2-hydroxy-2-methyl-1-phenylpropan-1-one, compound I, a mixture of compound I and compound II and compound III:

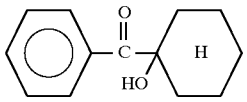

Compound I

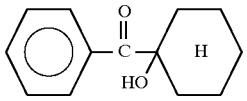

Compound I

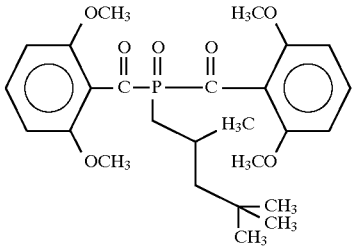

Compound II

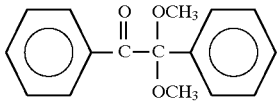

Compound III

The initiator can be incorporated in the toner particles together with the UV curable system or can be incorporated in the substrate.

This embodiment has the advantage that the resins comprised in the fused image are cross-linked (by UV-curing) and attached to the substrate by chemical bonds.

When UW-curable or radiation curable compounds are used in the first embodiment of the present invention, it is possible to do so in various combinations:

i) both a UV-curable compound (or a mixture of UV-curable compounds) and a photoinitiator (or mixture of photoinitiators) are only incorporated in the toner particles, not in the substrate, ii) both a UV-curable compound (or a mixture of UV-curable compounds) and a photoinitiator (or mixture of photoinitiators) are incorporated in the toner particles, and a UV-curable compound (or a mixture of UV-curable compounds) is incorporated in the substrate, ii) a UV curable compound (or a mixture of UV-curable compounds) is incorporated in the toner particles and both a UV-curable compound (or a mixture of UV-curable compounds) and a photoinitiator (or mixture of photoinitiators) are incorporated in the substrate, iv) a UV curable compound (or a mixture of UV-curable compounds) is incorporated in the toner particles and a photoinitiator (or mixture of photoinitiators) is incorporated in the substrate.

A substrate useful in the first embodiment of the invention comprises reactive groups RGB. This reactive groups (RGB) in the substrate, useful in the present invention, are in principle a member of the same group of reactive groups as the reactive groups RGA present in the toner particles, i.e. the reactive groups RGB are preferably members selected from the group consisting of epoxy groups, aldehyde groups, hydroxyl groups, carboxyl groups, mercapto groups, amino groups and amide groups. The reactive groups RGB can be part of a polymeric, oligomeric or low molecular weight (molecular weight lower than 2000) molecule. The molecule carrying reactive groups RGB can carry one or more of these reactive groups.

In this invention the reactive groups RGB are chosen in such a way that they are capable to react with one or more reactive groups RGA present in the toner particles. When e.g. in the toner particles, hydroxyl and/or carboxyl groups are present, the substrate comprises reactive groups capable of an easy reaction with said hydroxyl and/or carboxyl groups. Typical examples of such reactive groups are epoxy groups, aldehyde groups, polyaziridine groups, etc. When e.g. in the toner particles an epoxy group is present as reactive group RGA, the substrate preferably comprises as reactive group RGB either a hydroxyl, carboxyl, amide or amino group. When reaction pairs as described above are used it is preferred to incorporate the low molecular weight compounds or the oligomeric or polymeric compounds having a Tg<35° C. in the substrate. Thus very suitable compounds carrying reactive groups RGB for incorporation in the substrate are e.g. polyaziridines, polyamidoamine resins, highly methylated melamine resins, hydroxyl group containing epoxy hardening agents, e.g. reaction products of epichlorohydrin and HO—($CH_2$—CHOH—$CH_2$—O—)$_n$—H wherein n is an integer between 3 and 10, reaction products of epichlorohydrin and HO—($CH_2$—CHOR—$CH_2$—O—)$_n$—H wherein n is an integer between 3 and 10, and R is alkyl group. Further useful epoxy hardening agents are exemplified in e.g. EP-A 495 314 on page 23 to 26. Also epoxy hardening agents represented by formulas A-1 to A-6 can be used in the present invention.

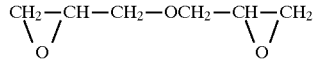
(A-1)

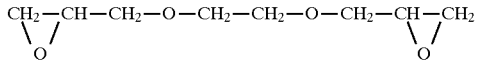
(A-2)

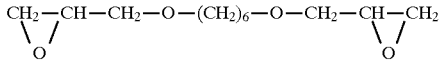
(A-3)

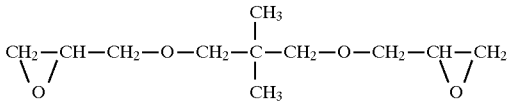
(A-4)

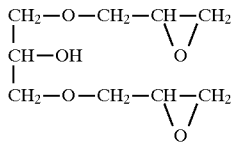
(A-5)

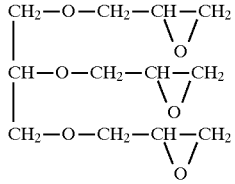
(A-6)

The compounds with reactive groups (RGB) can be comprised in a toner receptive layer applied to the substrate. The substrate can be paper, cardboard, plastic film, etc. Said toner receptive layer can comprise a binder and the compounds with reactive groups RGB can be embedded in said binder. The reactive groups RGB can form part of said binder. Useful binders, carrying reactive groups RGB, are e.g. the same binders as already described herein above as useful binders for the toner particles, i.e. polymers having an acid value>2.5 mg KOH/g and/or a hydroxyl value>2.5 mg KOH/g (examples of such polymers are found in table 1) and epoxy polymers. E.g. polymers useful as binder in a substrate to be used according to this invention and capable of reacting with a hydroxyl or carboxyl group (comprised in the toner particles) are epoxy polymers, polymers carrying aldehyde groups, polyaziridines, etc. When the toner particles comprise epoxy groups or aldehyde groups, then the binder in the image receiving layer of the substrate for use in this invention will preferably comprise hydroxyl, carboxyl and/or amino groups. Typical useful binders are gelatin, polyvynilalcohol, etc. The binder can also comprise further resinous compounds : e.g. polyamides, carboxyl or sulphonyl group containing polyesters in latex form, etc.

When the toner particles further comprise radiation curable (photopolymerizable) monomers, oligomers or polymers, the substrate can comprise initiators for radiation curing.

The substrate, within the scope of this invention, may further comprise a radiation curable compound and/or a photoinitiator as describe above. It is possible that the substrate comprises said radiation curable compound and that toner particles comprise an initiator for radiation curing as described above.

As stated above, the hardening reaction (the reaction between reactive groups RGA and RGB), according to this invention, proceeds easily when the interpenetration between toner particles and substrate is quite high. This interpenetration is reached by heating the toner particles on the substrate (during fixing or after fixing in an additional heating step) to a temperature that preferably is at most 150°, most preferably 120° C. Thus it is beneficial when at these temperatures the toner receiving layer has some fluidity. Therefore, the toner receiving layer on the substrate may comprise waxes or "heat solvents" also called "thermal solvents" or "thermosolvents" improving the penetration of the reagents RGA and RGB and thereby the reaction speed of hardening reaction at elevated temperature.

By the term "heat solvent" in this invention is meant a non-hydrolyzable organic material which is in solid state at temperatures below 50° C. but becomes on heating above that temperature a plasticizer for the binder of the layer wherein they are incorporated. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1,1-dioxide, methyl anisate and 1,10-decanediol described as heat solvents in Research Disclosure, December 1976, (item 15027) pages 26–28. Still other examples of heat solvents have been described in U.S. Pat. Nos. 3,438,776, and 4,740,446, and in published EP-A 0 119 615 and 0 122 512 and DE-A 3 339 810.

Said toner receiving layer may comprise, apart from a compound comprising reactive groups RGB or mixtures thereof and a binding agent or mixture of binding agents, also stabilizers, toning agents, antistatic agents, spacing particles (both polymeric or anorganic).

In addition to said ingredients the toner receiving layer may contain other additives such as free fatty acids, antistatic agents, e.g. non-ionic antistatic agents including a fluorocarbon group as e.g. in $F_3C(CF_2)_6CONH(CH_2CH_2O)$—H, ultraviolet light absorbing compounds, white light reflecting and/or ultraviolet radiation reflecting pigments, and/or optical brightening agents.

This first embodiment of the invention encompasses also an apparatus for forming an image comprising hardened toner particles comprising:

i) means for image-wise applying toner particles comprising reactive groups RGA on a substrate comprising reactive groups RGB, ii) means for fusing said toner particles to said substrate, forming a fused and hardened toner image.

The first embodiment of the invention comprises further an apparatus for forming an image comprising hardened toner particles comprising:

i) means for image-wise applying toner particles comprising reactive groups RGA, a UV curable compound and a photoinitiator on a substrate comprising reactive groups RGB, ii) means for fusing said toner particles to said substrate, forming a fused and hardened toner image, and iii) means for UV curing said UV curable compound.

The means for UV-curing are preferably UV-lamps. In an apparatus according to the present invention, it is preferred that the radiation (UV-) curing proceeds on-line. Therefore it is preferred that said means for fusing said toner images emit infrared radiation (are infra-red radiators) and said means for UV curing (e.g. one or more UV emitting lamps as, e.g. high pressure mercury lamps) are installed immediately after said fusing means so that the UV curing proceed on the still molten toner image. A combination of infra-red radiators (the means for fusing the toner particles) and UV emitting lamps (the means for radiation curing) in a single station (a fixing/curing station), so that the fusing and the radiation curing proceed simultaneously, is also a desirable design feature of an apparatus according to this invention. The apparatus according to the present invention can comprise if so desired, more than one fixing/curing station. The UV emitting means are preferably UV radiators with a capacity (an intensity) between 20 W/cm and 150 W/cm.

When the toner particles further comprise a UV curable compound, it is preferred that said means for fusing said toner images emit infrared radiation and said means for UV curing (e.g. one or more UV emitting lamps) are installed immediately after said fusing means so that the UV curing proceed on the still molten toner image.

THE SECOND EMBODIMENT OF THE INVENTION

In the second embodiment of the invention, the reactive groups RGB are applied on top of the toner image.

In the second embodiment of the invention, the same toner particles can be used as those used in the first embodiment of the invention and having been described above.

The substrate used in this second embodiment can be any substrate known in the art, e.g. plastic film, paper, cardboard, etc. It can also be a substrate comprising reactive groups RGB as described above under the first embodiment of the present invention.

The reactive compound that is applied on top of the image-wise deposited toner particles is a compound comprising reactive groups RGB that can react with the toner particles. The compounds carrying reactive groups RGB are applied to the image in an amount between 1 and 10 $g/m^2$, preferably between 2 and 8 $g/m^2$.

Typical couples of compounds, comprising reactive groups RGA or RGB, and very useful in the present invention are the same as those exemplified above.

In this second embodiment of the invention, it is also preferred that the toner particles comprise resins with $Tg \geqq 35°$ C. containing reactive groups RGA.

The compounds carrying reactive groups RGB can, in the second embodiment of the invention, be applied to the toner image either before or after fusing of the toner particles to the substrate. When the compounds comprising reactive groups RGB are applied to the toner image before fusing, it is preferred to use spray coating techniques to apply said compounds. These compounds may be applied as such, as a solution or as a dispersion, depending on the physical nature of the compound carrying reactive groups RGB.

In the second embodiment of the invention it is possible to cover the toner image by an non-image-wise applied layer of clear toner particles wherein said clear toner particles comprise reactive groups RGB and wherein the compounds carrying reactive groups RGB have a $Tg \geqq 35°$ C. The word "clear" means herein not giving, in a wavelength range extending from 400 to 700 nm, a visible diffuse density, said visible diffuse density being defined as less than 15% light reduction integrated over that wavelength range. In this case said toner particles are applied onto the toner image before fusing.

It is also possible to cover the toner image with a layer of clear toner particles that do not comprises reactive groups RGB capable of reacting with the reactive groups RGA contained in the image forming toner particles, but comprising reactive groups RGA. This layer of clear toner particles is then covered with a compound comprising reactive groups RGB. Afterwards, both reactive groups are made to react together to harden the outermost toner layer in the toner image. When a layer of clear toner particles is applied to toner images made up by the overlay of several layers of different types of toner particles (e.g. in full colour toner images or in a black and white (monochrome) image with extended tonal range as disclosed in EP-A 768 577 and in which a relief structure is present, it is possible to apply said layer of clear toner particles "counter image-wise", such that a thicker fixed clear finish layer is present in the lower thickness areas of the image and a thinner fixed clear finish layer is present in the higher thickness areas of the image.

The present invention includes also an apparatus for forming an image comprising hardened toner particles comprising:

i) means for image-wise applying toner particles comprising reactive groups RGA on a substrate, ii) means for fusing said toner particles to said substrate, forming a fused toner image characterised in that it further comprises means for applying a compound comprising reactive groups RGB on top of said image-wise applied toner particles.

Said means for applying said compound carrying reactive groups RGB can be rollers, wicks, sprays, etc. When said means for applying compound carrying reactive groups RGB are rollers, it may be split rollers, e.g. when 5 g/m$^2$ of compound carrying reactive groups RGB has to be applied, there may be provided four application rollers, the first two applying together 2 g/m$^2$ of compound carrying reactive groups RGB and the following rollers applying the remaining 3 g/m$^2$. Preferred means for applying said compound carrying reactive groups RGB are supply rollers with a surface in NOMEX-felt (NOMEX is a trade name of Du Pont de Nemours, Wilmington, US) as described in article titled "Innovative Release Agent Delivery Systems" by R. Bucher et al. in The proceedings of IS&T's Eleventh International Congress on Advances in Non-Impact Printing Technologies, page 219–222. This congress was held in Hilton Head, from 29.10.95 to 03.11.95. The proceedings are published by IS&T, Springfield, US 1995. The compound carrying reactive groups RGB can be delivered to the image directly by supply rollers as described above, or over an intermediate roller, which distributes the compound even more evenly over the image.

Said means for applying a compound comprising reactive groups RGB on top of a toner image may be installed before said means for fusing said toner particles or after said means for fusing said toner particles to said substrate.

When said means for applying a compound comprising reactive groups RGB are installed after the fusing means, the reactive groups RGB are applied on top of a fused, still warm, toner image and the apparatus comprises preferably also special means for reacting said reactive groups RGA and RGB so as to harden said fused toner image. These special means are heating means, that may be the same means as those used as fusing means.

When said means for applying the compound comprising reactive groups RGB are installed before said means for fusing said toner particles, these means for applying the compounds with reactive groups RGB are preferably means for non-contact application, e.g. spraying means and no special means for reacting said reactive groups RGA and RGB so as to harden said fused toner image are necessary since the reaction of reactive groups RGA and RGB proceeds during the fusing step.

Also in this second embodiment of the invention, it is possible to use toner particles and/or substrates that further comprise radiation curable, preferably UV-curable compounds as described above. Thus the second embodiment of the invention includes a method for forming toner images on a substrate comprising the steps of:

i) providing a substrate comprising reactive groups RGB, i)image-wise applying toner particles comprising reactive groups RGA, a UV curable compound and a photoinitiator on said substrate, ii) fusing said toner particles to said substrate, forming a fused and toner image, iii) applying a compound comprising reactive groups RGB on top of said image-wise applied toner particles iv) reacting said reactive groups RGA with said reactive groups RGB and v) UV curing said UV curable compound.

In this method the step of UV curing can proceed on line, e.g, in the fusing station itself of an electrostatographic apparatus or in a station immediately adjacent to said fusing station.

The radiation curing can proceed off-line in a separate apparatus wherein the fused layer of toner particles is heated again and irradiated with curing rays.

Also within the scope of the present invention is an apparatus for forming an image comprising hardened toner particles comprising:

i) means for image-wise applying toner particles, comprising reactive groups RGA, a UV curable compound and a photoinitiator on a substrate, ii) means for fusing said toner particles to said substrate, forming a fused toner image, characterised in that it further comprises means for applying a compound comprising reactive groups RGB on top of said image-wise applied toner particles and means for UV curing said UV curable compound.

In such an apparatus the means for fusing and the means for UV curing can be the same as described above under the first embodiment of the present invention.

The present invention can be practised in any electrographic or magnetographic imaging method. It can be useful in classical electrophotography, in ionography, in direct electrostatic printing (DEP), etc. The present invention is useful for mono-chromatic toner images as well as for multi-chromatic and full colour toner images.

Thus in the apparatus, within the scope of the invention, the means for image-wise depositing toner particles can be direct electrostatic printing means, wherein charged toner particles are attracted to the substrate by an electrical field and the toner flow modulated by a printhead structure comprising printing apertures and control electrodes.

Said means for image-wise depositing toner particles can also be toner depositing means wherein first a latent image is formed. In such an apparatus, within the scope of the present invention, said means for image-wise depositing toner particles) comprise:

means for producing a latent image on a latent image bearing member, means for developing said latent image by the deposition of said toner particles, forming a developed image and means for transferring said developed image on said substrate.

Said latent image may be a magnetic latent image that is developed by magnetic toner particles (magnetography) or, preferably, an electrostatic latent image. Such an electrostatic latent image is preferably an electrophotographic latent image and the means for producing a latent image are in this invention preferably light emitting means, e.g., light emitting diodes or lasers and said latent image bearing member comprises preferably a photoconductor.

Toner particles useful in both embodiments of this invention can have an average volume diameter between 1 and 50 μm, preferably between 3 and 20 μm. When the toner particles are intended for use in colour imaging, it is preferred that the volume average diameter is between 3 and 10 μm, most preferred between 3 and 8 μm. The particle size distribution of said toner particles can be of any type. It is however preferred to have an essentially (some negative or positive skewness can be tolerated, although a positive skewness, giving less smaller particles than an unskewed distribution, is preferred) Gaussian or normal particle size distribution, either by number or volume, with a coefficient of variability (standard deviation divided by the average) (v) smaller than 0.5, more preferably of 0.3.

Toner particles, useful in the first embodiment of this invention, can comprise any normal toner ingredient e.g. charge control agents, pigments both coloured and black, inorganic fillers, etc. A description of charge control agents, pigments and other additives useful in toner particles, to be used in a toner composition according to the present invention, can be found in e.g. EP-A 601 235.

The toner particles can be used as mono-component developers, both as a magnetic and as a non-magnetic mono-component developer. The toner particles can be used in a multi-component developer wherein both magnetic carrier particles and toner particles are present. The toner particles can be negatively charged as well as positively charged.

EXAMPLE 1

Toner particles 49 parts of a polyester of fumaric acid and DIANOL 33 (n° 2 in Table 1) and 49 parts of a polyester of terephthalic acid, isophthalic acid and DIANOL 22 and ethyleneglycol (n° 3 in Table 1) were melt-blended for 30 minutes at 110° C. in a laboratory kneader with 2 parts of Cu-phthalocyanine pigment (Colour Index PB 15:3).

After cooling the solidified mass was pulverized and milled using an ALPINE Fliessbettgegenstrahlmühle type 100AFG (tradename) and further classified using an ALPINE multiplex zig-zag classifier type 100OMZR (tradename). The average particle size of the separated toner was measured by Coulter Counter model Multisizer (tradename) was found to be 8.0 μm by volume.

Developer 4 parts of toner particles, 0.5 parts of hydrophobic colloidal. silica particles (BET-value 130 $m^2/g$) were mixed with 95.5 parts silicone-coated Cu-Zn ferrite carrier particles having an average diameter of 55 μm.

Substrate

On a part of the glossy side of ZANDERS PAPER (tradename) a solution of 25.9 g melamine-formaldehyde (CYMEL 303,

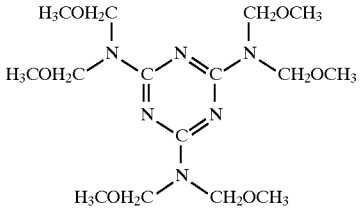

tradename of American Cyanamid Company USA) and 2.6 g p-toluenesuiphonic acid (catalyser) in 71.5 g Methyl-Ethyleketone was coated by a bar coater at a wet thickness of 20 μm. After drying for 30 minutes at 50° C., the dry layer had a thickness of 6 μm. On an adjacent part of the glossy side of said paper no toner receiving layer was present.

Printing

Printing proceeded in an AGFA XC305 colour copier. The image was printed both on the part of the paper having a receiving layer and the part not having a receiving layer. After fixing of the image, the resistance of the image against solvents was tested by rubbing the image 10 consecutive times with a cloth soaked with MEK (methylethyleketone). The image on the part comprising the receiving layer according to this invention, resisted the rubbing for ten times, whereas the image on the part not having the receiving layer disappeared after rubbing once.

EXAMPLE 2

1. Preparation of the toner particles and the developers

Yellow toner (Y)

49 parts of a polyester with acid value AV of 17 mg KOH/g (number 2 of Table 1) and 49 parts of a polyester with AV of 18 mg KOH/g (number 3 of Table 1) were melt-blended for 30 minutes at 110° C. in a laboratory kneader with 2 parts of SICOECHTGELB D 1355 DD (Colour Index PY 13, trade name of BASF AG, Germany).

After cooling the solidified mass was pulverized and milled using an ALPINE Fliessbettgegenstrahlmuhle type 100AFG (tradename) and further classified using an ALPINE multiplex zig-zag classifier type 100MZR (tradename). The average particle size of the separated toner was measured by Coulter Counter model Multisizer (tradename) was found to be 8.0 μm by volume.

To improve the flowability of the toner mass the toner particles were mixed with 0.5% of hydrophobic colloidal silica particles (BET-value 130 $m^2/g$).

Magenta Toner (M)

The preparation of the Yellow toner was repeated, but instead of 2 parts SICOECHTGELB PY13, 2 parts of PERMANENT CARMIN FFB 02 (Colour Index PR146, tradename of Hoechst AG, Germany) were used.

Cyan toner (C)

The preparation of the Yellow toner was repeated, but instead of 2 parts SICOECHTGELB PY13, 2 parts of HELIOGEN BLAU D7072DD (Colour Index PB15:3, trade name of BASF AG, Germany) were used.

Black toner (K)

The preparation of the Yellow toner was repeated, but instead of 2 parts SICOECHTGELB PY13, 2 parts of CABOT REGAL 400 (carbon black, trade name of the Cabot Corp. High Street 125, Boston, U.S.A.) were used.

The four toners, Y, M, C and K had a meltviscosity at 120° C. of 500 Pas.

Clear toner (CT) 100 parts of an epoxy resin EPIKOTE 1004 (trade mark of the Shell Chemical Co) were melt-blended for 30 minutes at 110° C. in a laboratory kneader.

After cooling the solidified mass was pulverized and milled using an ALPINE Fliessbettgegenstrahlmühle type 100AFG (tradename) and further classified using an ALPINE multiplex zig-zag classifier type 100MZR (tradename). The average particle size of the separated toner was measured by Coulter Counter model Multisizer (tradename) was found to be 8.0 μm by volume. The clear toner CT had a meltviscosity at 120° C. of 150 Pas.

To improve the flowability of the toner mass the toner particles were mixed with 0.5% of hydrophobic colloidal silica particles (BET-value 130 $m^2/g$).

Developers

Each of the above prepared toners were used to form carrier-toner developers by mixing said mixture of toner particles and colloidal silica in a 4% ratio with silicone-coated Cu-Zn ferrite carrier particles having an average diameter of 55 $\mu$m.

2. Printing Examples

Full colour toner images were produced using a commercial CHROMAPRESS (a trade name of Agfa-Gevaert N V, Mortsel, Belgium). The images were covered with a layer of clear toner such that 0.9 mg/cm$^2$ clear toner was present.

The fusing took place with radiant heat.

On top of the layer of clear toner a solution of 20 g of a polyaminoamide resin (UNIREZ 1307 trade name) with amino value between 370 and 410 mg KOH/g and 1.6 g of a catalyser (XB 3130 trade name of Ciba Geigy, Switserland) was applied at a wet thickness of 4 $\mu$m (i.e. 4 g of polyaminoamide resin per m$^2$). The image was kept for 1 minute at 125° C.

After cooling the image, the resistance of the image against solvents was tested by rubbing the image 10 consecutive times with a cloth soaked with MEK (methylethyleketone). The image on the part being treated with a hardener according to this invention, resisted the rubbing for ten times, whereas the image on the part not being treated layer disappeared after rubbing once.

We claim:

1. A method for forming toner images on a substrate comprising the steps of:

i) providing a substrate having a support and a toner receiving layer thereon, said receiving layer containing at least one reactive group RGB, ii) providing toner particles containing a least one reactive group RCA, a radiation curable compound and an initiator for radiation curing, iii) image-wise depositing said toner particles on said substrate, forming an image and iv) reacting said reactive group RGA with reactive group RGB so as to harden said toner particles.

2. A method according to claim 1, wherein said toner particles contain a toner resin carrying said at least one reactive group RGA.

3. A method according to claim 2, wherein said resin carrying said reactive group RGA has a Tg≧35° C.

4. A method according to claim 1, wherein said reactive group RGA and said reactive group RGB are members selected from the group consisting of epoxy groups, aldehyde groups, hydroxyl groups, carboxyl groups, mercapto groups, amino groups and amide groups.

5. A method according to claim 1, wherein said reactive group RGA and said reactive group RGB are comprised in compounds forming reaction pairs said pairs being members selected from the group consisting of:

polyaminoamide resins having an amine value between 140 and 430 mg KOH/g with compounds comprising epoxy groups, polymers having an acid value larger than 2.5 mg KOH/g with compounds carrying epoxy groups, polymers having a hydroxyl value larger than 2.5 mg KOH/g with compounds carrying epoxy groups, polymers comprising epoxy groups with polyaziridines, polymers having an acid value larger than 2.5 mg KOH/g with polyaziridines polymers having a hydroxyl value larger than 2.5 mg KOH/g with polyaziridines, polymers having an acid value larger than 2.5 mg KOH/g with polyabietic acid polymers having a hydroxyl value larger than 2.5 mg KOH/g with polyabietic acid, polymers having an acid value larger than 2.5 mg KOH/g with highly methylated melamine resins, polymers having a hydroxyl value larger than 2.5 mg KOH/g with highly methylated melamine resins, polyamide resins with hardening agents comprising epoxy groups and polyester/polyamide copolymers with hardening agents comprising epoxy groups.

6. A method according to claim 1, wherein said receiving layer further comprises a catalyzer.

7. A method according to claim 1, wherein said receiving layer further comprises a radiation curable compound.

8. In an apparatus for forming images comprising hardened toner particles comprising means for image-wise applying toner particles comprising at least one epoxy group on a substrate, means for fusing said toner particles to said substrate, forming a fused toner image, the improvement comprises that said apparatus further has means for applying a compound carrying at least one reactive group RGB, being part of a polyaminoamide resin having an amine value between 140 and 430 mg KOH/g on top of said image-wise applied toner particles.

9. A method for forming toner images on a substrate comprising the steps of:

i) providing a substrate having a support and a toner receiving layer thereon, said receiving layer containing at least one reactive group RGB and an initiator for radiation curing, ii) providing toner particles containing a least one reactive group RCA, and a radiation curable compound, iii) image-wise depositing said toner particles on said substrate, forming an image and iv) reacting said reactive group RGA with reactive group RGB so as to harden said toner particles.

10. A method according to claim 9, wherein said receiving layer further comprises a radiation curable compound.

11. A method according to claim 9, wherein said toner particles contain a toner resin carrying said at least one reactive group RGA.

12. A method according to claim 11, wherein said resin carrying said reactive group RCA has a Tg≧35° C.

13. A method according to claim 9, wherein said reactive group RGA and said reactive group RGB are members selected from the group consisting of epoxy groups, aldehyde groups, hydroxyl groups, carboxyl groups, mercapto groups, amino groups and amide groups.

14. A method according to claim 9, wherein said reactive group RGA and said reactive group RGB are comprised in compounds forming reaction pairs said pairs being members selected from the group consisting of:

polyaminoamide resins having an amine value between 140 and 430 mg KOH/g with compounds comprising epoxy groups, polymers having an acid value larger than 2.5 mg KOH/g with compounds carrying epoxy group, polymers having a hydroxyl value larger than 2.5 mg KOH/g with compounds carrying epoxy groups, polymers comprising epoxy groups with polyaziridines, polymers having an acid value larger than 2.5 mg KOH/g with polyaziridines, polymers having a hydroxyl value larger than 2.5 mg KOH/g with polyaziridines, polymers having an acid value larger than 2.5 mg KOH/g with polyabietic acid, polymers having a hydroxyl value larger than 2.5 mg KOH/g with polyabietic acid, polymers having an acid value larger than 2.5 mg KOH/g with highly methylated melamine resins, polymers having a hydroxyl value larger than 2.5 mg KOH/g with highly methylated melamine resins, polyamide resins with hardening agents comprising epoxy groups and polyester/polyamide copolymers with hardening agents comprising epoxy groups.

15. A method according to claim 9, wherein said receiving layer further comprises a catalyzer.

16. A method for forming toner images comprising the steps of:

i) providing toner particles comprising at least one epoxy group, ii) image-wise depositing said toner particles on a substrate, iii) applying a compound comprising at least one reactive group RGB, being part of a polyaminoamide resin having an amine value between 140 and 430 mg KOH/g on said image and iv) reacting said epoxy group with said reactive group RGB so as to harden said toner particles.

* * * * *